340-870.12 SR
12/10/85 XR 4,558,319

United States Patent [19]

Shum

[11] Patent Number: 4,558,319

[45] Date of Patent: Dec. 10, 1985

[54] AUTOMATED SYSTEM MONITORING USING FREQUENCY AND AMPLITUDE MODULATION

[75] Inventor: Lanson Y. Shum, Wexford, Pa.

[73] Assignee: Westinghouse Electric Corp., Pittsburgh, Pa.

[21] Appl. No.: 447,568

[22] Filed: Dec. 7, 1982

[51] Int. Cl.[4] ..... G08B 21/00; G08B 19/00; G08C 19/16; G08C 25/02

[52] U.S. Cl. ..... 340/870.09; 340/870.12; 340/870.18; 340/870.42; 340/692; 364/513; 367/198

[58] Field of Search ..... 340/870.11, 870.12, 340/692, 870.09, 870.16, 870.18, 870.42, 870.43; 364/513; 367/198

[56] References Cited

U.S. PATENT DOCUMENTS

| | | | |
|---|---|---|---|
| 2,494,370 | 1/1950 | Swartzel | 340/870.12 |
| 3,270,321 | 8/1966 | Berkowitz | 340/870.11 |
| 3,290,667 | 12/1966 | Stine | 340/870.12 |
| 3,550,124 | 12/1970 | Heft | 340/870.18 |
| 3,946,157 | 3/1976 | Dreyfus | 367/198 |
| 4,253,192 | 2/1981 | Donnally | 340/870.18 |
| 4,455,551 | 6/1984 | Lemelson | 340/870.09 |

*Primary Examiner*—James J. Groody
*Attorney, Agent, or Firm*—Michael P. Lynch; Thomas R. Trempus

[57] ABSTRACT

In automatic assembly or processing operations employing multiple machines or robots, a signal preprocessor employing frequency and amplitude modulation techniques translates a plurality of monitored condition signals associated with each machine or robot into a composite audio signal.

The time-varying composite audio signal represents a unique audio signature of the status of the assembly or process operation at any given time. This composite audio signal is available for analysis by an operator or an audio recognition system to detect variations in the composite audio signal which identify impending operational irregularities in the process being performed.

17 Claims, 1 Drawing Figure

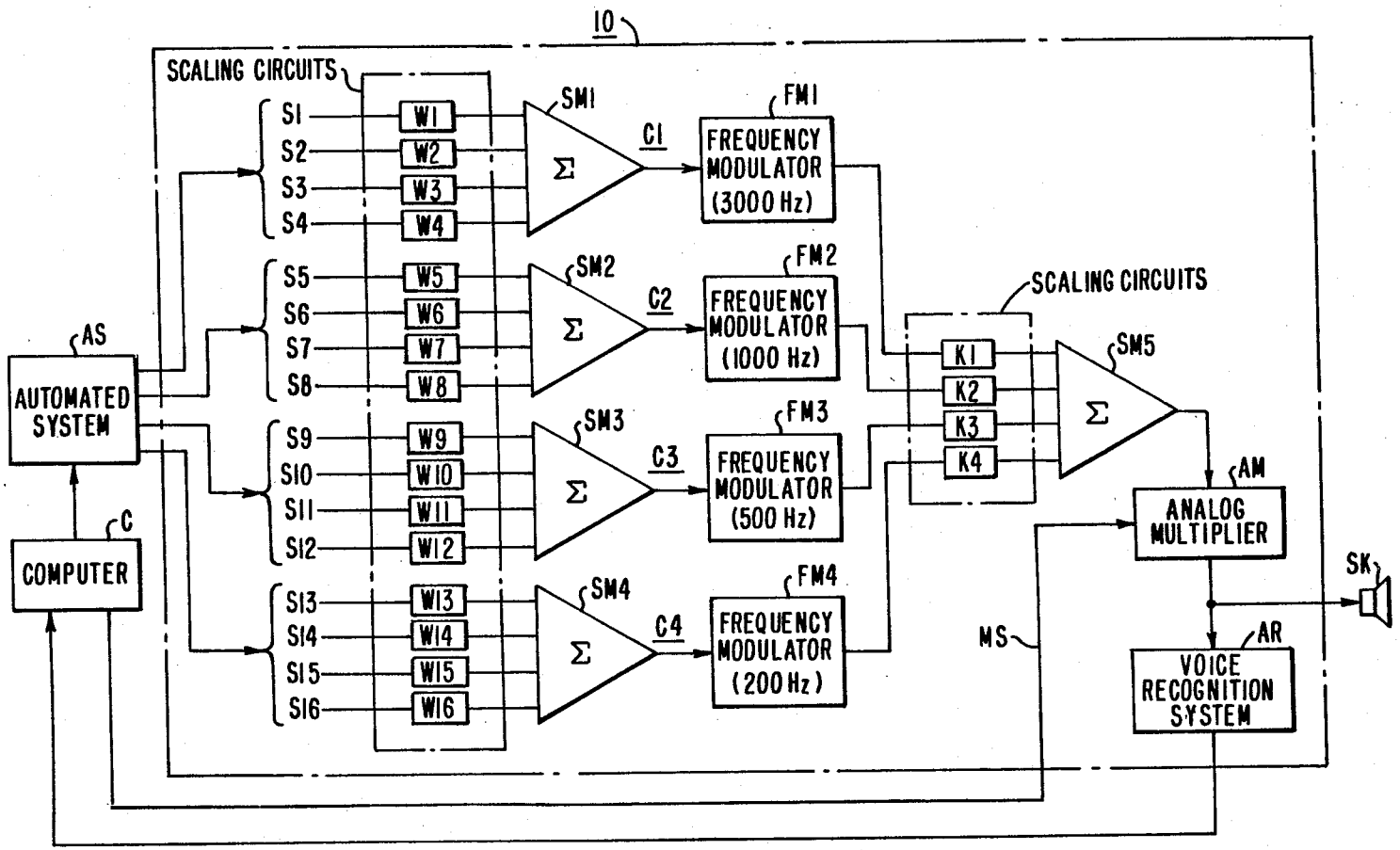
10
SCALING CIRCUITS
S1
S2
S3
S4
S5
S6
S7
S8
S9
S10
S11
S12
S13
S14
S15
S16
W1
W2
W3
W4
W5
W6
W7
W8
W9
W10
W11
W12
W13
W14
W15
W16
SM1
SM2
SM3
SM4
C1
C2
C3
C4
FM1
FREQUENCY MODULATOR (3000 Hz)
FM2
FREQUENCY MODULATOR (1000 Hz)
FM3
FREQUENCY MODULATOR (500 Hz)
FM4
FREQUENCY MODULATOR (200 Hz)
SCALING CIRCUITS
K1
K2
K3
K4
SM5
AM
ANALOG MULTIPLIER
AR
VOICE RECOGNITION SYSTEM
SK
MS
AS
AUTOMATED SYSTEM
C
COMPUTER

AUTOMATED SYSTEM MONITORING USING FREQUENCY AND AMPLITUDE MODULATION

BACKGROUND OF THE INVENTION

The operational status of automated assembly or process systems is continuously monitored to recognize impending operational problems which could result in expensive downtime as a result of machine jamming or unacceptable tool wear.

Numerous parameters are measured including motor current and voltage, force conditions in component assembly operations, limit conditions in industrial processes, etc. The monitored condition signals may originate as binary signals, current and voltage signals, force signals, strain gauge signals, on-off limit switch conditions, etc. The processing of these monitored condition signals has typically required redundant and expensive signal processing channels.

SUMMARY OF THE INVENTION

There is described herein with reference to the accompanying drawing a signal modulation technique that combines a plurality of monitored condition signals from an automated system or robot to form a single composite audio signal. The composite audio signal is analyzed by a trainable single speaker speech recognition system to acknowledge impending operational irregularities in the automated system or robot. The disclosed technique enables a wide variety of automated systems to be monitored by a single remote supervisory system through multiplexing.

BRIEF DESCRIPTION OF THE DRAWINGS

The invention will become more readily apparent from the following exemplary description in connection with the schematic illustration of the inventive concept in conjunction with an automated assembly operation.

DESCRIPTION OF THE PREFERRED EMBODIMENT

Referring to the drawing, there is schematically illustrated a frequency-modulated and amplitude-modulated pre-processor circuit 10 operatively coupled to a typical automated system as which is operating in accordance with instructions or controls generated by a programmed control system such as the computer C. The automated system AS may be such as that used for implementing a process such as assembly, welding, etc.

The pre-processor circuit 10 monitors a plurality of conditions within the automated system AS during the prescribed process to identify variations in conditions during the process which could adversely affect the quality of the finished product or the operational integrity of the automated system AS.

The monitored conditions, as represented by monitoring signals S1–S16, may be analog or digital signals transmitted from the automated system AS which are indicative of voltage or current measurements associated with motors; strain gauge signals; limit switch conditions; binary signals, etc. The analog signals S1–S16 provide a continuous indication of time varying conditions representative of the operational integrity of the components and equipment comprising the automated system AS and the quality of the process being performed by the system AS. While an automated system AS has been typically identified as performing an assembly process, the following discussion of the pre-processor circuit 10 is equally applicable to any automated system.

The frequency-modulated, amplitude-modulated pre-processor circuit 10 consists of a plurality of FM modulator channels C1, C2, C3 and C4, each accommodating a predetermined number of condition monitoring signals from the system AS and developing an analog audio output signal. The analog audio output signals of the respective frequency modulator channels are in turn combined to form a time varying composite audio signal which is compared to a plurality of stored process conditions in an audio recognition system to match the composite audio signal to one of the stored conditions.

The most rapidly changing monitoring signals, S1–S4, are supplied to the frequency modulator channel C1 which includes a frequency modulator FM1 having a center frequency of 3000 Hz and a maximum frequency swing of approximately 50% of the center frequency. The next most rapidly changing monitoring signals correspond to signals S5–S8, which serve as input signals to the frequency modulator channel C2, which includes a frequency modulator FM2 having a center frequency of 1000 Hz and a maximum frequency swing of approximately 50% of the center frequency. Similarly, the next most rapidly changing monitoring signals correspond to signal group S9–S12, which serve as input signals to frequency modulator channel C3. FM channel C3 includes a frequency modulator circuit FM3 having a center frequency of 500 Hz and a maximum frequency swing of approximately 50% of the center frequency. The monitoring signals exhibiting the slowest rate of change with respect to time correspond to signals S13–S16 which are supplied to frequency modulator channel C4 which includes a frequency modulator circuit FM4 having a center frequency of 200 Hz and a maximum frequency swing of approximately 50% of the center frequency. While the center frequency of the respective FM modulators can vary depending on the application, the frequency ranges are selected to correspond to frequency formants present in human speech. Overlapping the frequency bands of the respective frequency modulator channels produces a unique composite audio waveform.

The monitoring signals S1–S4 are supplied to scaling circuits W1–W4, respectively, with each scaling circuit serving either as an attenuator or amplifier such that a maximum magnitude condition for each of the signals S1–S4 will not result in saturation of the summing amplifier SM1. The scaling circuits W1–W4 can further be employed to establish a priority rating for the input monitoring signals such that predetermined monitored conditions in the automated system AS can be given priority due to the significance of that particular condition in the process being performed. This priority is achieved by enhancing one or more of the monitoring signals through the operation of the scaling circuits W1–W4. The summing amplifier SM1 sums the time-varying analog signals S1–S4 and supplies the resulting time-varying analog signal to the frequency modulator circuit FM1. A similar scaling, summing and frequency modulating operation is performed on monitoring signals S5–S8, S9–S12, and S13–S16, by frequency modulator channels C2, C3 and C4, respectively, to develop frequency modulated output signals from frequency modulator circuits FM2, FM3 and FM4. The frequency modulated output signals of the circuits FM1, FM2, FM3 and FM4 undergo signal conditioning by scaling circuits K1, K2, K3 and K4 to achieve desired signal priority and scaling before being combined by the summing circuit SM5.

The composite audio output signal of the summing circuit S5, which represents the collective summation of the monitoring signals S1–S16, is supplied to an analog multiplier circuit AM. The analog multiplier circuit AM functions as an amplitude modulator responding to a modulating signal MS developed by the control system, i.e., computer C, which is responsible for controlling the process cycle and operation of the automated system AS. The modulating signal MS is a programmable time-varying "weighing" function. The level, or magnitude, of the modulating signal MS varies in accordance with the degree of criticality of the process being performed by the system AS so as to enhance the amplitude modulated composite audio output signal of the analog multiplier AM at different stages or phases in the process cycle of the system AS. The composite audio signal developed by the analog multiplier AM corresponds to an audio signature describing the monitored conditions at any given point in time of the process being performed by the system AS. This unique audible signature is available for evaluation by an operator via an audio speaker SK, or by a commercially available single speaker audio recognition system AR. An operator familiar with the system operation and the time-varying audio signature indicative of acceptable system operation can audibly detect variations in the audio signature which are indicative of irregularities in the performance of the system AS.

The audio recognition system AR may be implemented through the use of commercially available voice recognition integrated circuits such as the voice recognition circuit VCR008 which is commercially available from Interstate Electronics Corporation. The audio recognition circuit AR is programmed to include numerous stored audio signature features corresponding to monitored conditions indicative of process operating conditions ranging from a variety of unacceptable monitored conditions to acceptable monitored conditions. In the event the process performed by the system AS is an assembly operation involving the insertion and assembly of a plurality of components, typical unacceptable monitored conditions would correspond to misaligned parts, the absence of parts, the improper fit of parts, etc.

The audio recognition system AR analyzes the formants and features of the composite audio signal developed by the analog multipler AM and compares the features to previously stored features which are stored as timevariant masks. It develops an output signal indicative of a match between the characteristics of the composite audio signal and a stored characteristic.

The output signal of the audio recognition system AR is available to the operator or the automated system control system C to initiate an appropriate response. In the event the composite audio signal from the analog multiplier AM corresponds to an unacceptable process condition, as represented by the output signal from the audio recognition system AR, the process being performed by the system AS can be temporarily interrupted to make the necessary adjustments thereby avoiding a costly and extended shutdown of the system AS.

A single audio recognition system AR could be used to monitor and evaluate the composite audio signals from a plurality of analog multipliers associated with different automated systems by coupling the output signals from each analog multiplier circuit to the audio recognition circuit via a conventional analog multiplexer. This technique could be employed to supervise automatic transfer lines or integrated multi-robot assembly lines.

I claim:

1. Apparatus for developing an audio signal indicative of the operational status of one or more automated systems such as that used for implementing a process such as assembly, welding, etc., comprising:

a plurality of sensor means for generating time varying monitoring signals indicative of a plurality of time varying operational conditions of said automated systems;

summing means for combining said plurality of monitoring signals and generating a single time varying analog signal;

FM modulator means having a frequency range within the audio range for generating a time varying audio output signal corresponding to said analog signal developed by said summing means;

audio signal responsive means for manifesting said time varying audio output signal as an indication of the operational status of said automated system; and analog multiplier means for coupling said audio output signal to said audio signal responsive means and means for supplying a modulating signal to said analog multiplier means, such that said analog multiplier means functions as an amplitude modulator, the level of said modulating signal varying in time with the process being performed by said automated system to critically weight predetermined phases of the process with respect to others and correspondingly modify said audio output signal on the basis of the significance of the relative phases of the process being performed by said automated system.

2. Apparatus as claimed in claim 1 wherein said audio signal responsive means is an audio speaker enabling an operator to audibly determine the operational status of the automated system.

3. Apparatus as claimed in claimed 1 wherein said audio signal responsive means is a voice recognition means including a plurality of stored audio signals representing a plurality of automated system operating conditions, said voice recognition means comparing said time varying audio output signal to said stored audio signals and generating an output signal indicative of a match thereby identifying the operational status of said automated system.

4. Apparatus as claimed in claim 1 further including:

circuit means coupling said monitoring signals to said summing means for weighting said monitoring signals to prioritize said monitoring signals.

5. Apparatus for developing an audio signal indicative of the operational status of one or more automated systems such as that employed for implementing a process such as assembly, welding, etc., comprising:

a plurality of sensor means for generating time varying monitoring signals indicative of a plurality of time varying operational conditions of said automated system, said sensor means comprising at least a first and second group, said first group corresponding to the sensor means generating the most rapidly changing time varying monitoring signals, said second group comprising the sensor means generating the next most rapidly changing time varying monitoring signals.

first and second FM modulator channel means operatively associated with said first and second group of sensor means respectively:

said first FM modulator channel means including:

(a) a first summing means for combining the time varying monitoring signals of said first group of sensor means and generating a single time varying analog output signal, (b) a first FM modulator means having a first predetermined frequency range within the audio range for generating a time varying audio signal corresponding to said analog output signal developed by said first summing means, said second FM modulator channel means including:

(a) a second summing means for combining the time varying monitoring signals of said second group of sensor means and generating a single time varying analog output signal, (b) a second FM modulator means having a second predetermined frequncy range within the audio range for generating a time varying audio signal corresponding to the analog output signal developed by said second summing means, third summing means for combining the time varying audio output signals of said first and second FM modulator means to produce a composite audio output signal indicative of the time varying monitoring signals developed by said plurality of sensor means; and audio signal responsive means for manifesting said time varying composite audio output signal as an indication of the operational status of said automated system.

6. Apparatus as claimed in claim 5 wherein said audio signal responsive means is an audio speaker enabling an operator to audibly determine the operational status of the automated system.

7. Apparatus as claimed in claim 5 wherein said audio signal responsive means is a voice recognition means including a plurality of stored audio signals representing a plurality of automated system operating conditions, said voice recognition means comparing the characteristics of said time varying composite audio output signal to said stored audio signals and generating an output signal indicative of a match thereby identifying the operational status of said automated system.

8. Apparatus as claimed in claim 5 further including:

circuit means coupling said monitoring signals to said first and second summing means for weighting said monitoring signals to prioritize said monitoring signals.

9. Apparatus as claimed in claim 5 further including an analog multiplier means for coupling said composite audio output signal from said third summing means to said audio signal responsive means and means for supplying a modulating signal to said analog multiplier, such that said analog multiplier functions as an amplitude modulator, the level of said modulating signal varying in time with the process being performed by said automated system to critically weight predetermined phases of the process with respect to others and correspondingly modify said composite audio output signal on the basis of the significance of the relative phases of the process being performed by said automated system.

10. Apparatus as claimed in claim 5 wherein the frequency ranges are selected to correspond to frequency formants present in human speech.

11. Apparatus as claimed in claim 5 wherein said first and second predetermined frequency ranges overlap.

12. A method for developing an audio signal indicative of the operational status of one or more automated systems such as that employed for implementing a process such as assembly, welding, etc., comprising:

generating time varying monitoring signals indicative of a plurality of time varying operational conditions of said automated system by a plurality of sensor means, said monitoring signals comprising at least a first and second group of signals, said first group of signals comprising the most rapidly changing time varying monitoring signals, and said second group of signals comprising the next most rapidly changing time varying monitoring signals;

modulating said first and second group of monitoring signals by means of a first and second FM modulator channel, respectively:

wherein a first modulating step includes:

(a) combining the time varying monitoring signals of said first group of signals and generating a single time varying analog output signals, (b) generating a time varying audio signal corresponding to said analog output signal developed by a first summing means by means of a first FM modulator means having a first predetermined frequency range within the audio range, wherein a second modulating step includes:

(a) combining the time varying monitoring signals of said second group of signals and generating a single time varying analog output signal by means of a second summing means, (b) generating a time varying audio signal corresponding to the analog output signal developed by said second summing means by means of a second FM modulator means having a second predetermined frequency range within the audio range, combining the time varying audio output signals of said first and second FM modulator means to produce a composite audio output signal indicative of the time varying monitoring signals developed by said plurality of signals by means of a third summing means; and manifesting said time varying composite audio output signal as an indication of the operational status of said automated system.

13. The method according to claim 12 including the step of enabling an operator to audibly determine the operational status of the automated system.

14. The method according to claim 12 including the step of storing a plurality of audio signals representing a plurality of automated system operating conditions, and comparing the characteristics of said time varying composite audio output signal to said stored audio signals and generating an output signal indicative of a match thereby identifying the operational status of said automated system.

15. The method according to claim 12 including the step of weighting the monitoring signals in order to prioritize the monitoring signals.

16. The method according to claim 12 including the step of selecting the frequency ranges to correspond to frequency formants present in human speech.

17. The method according to claim 12 including the step of overlapping the first and second predetermined frequency ranges.

* * * * *